US008813444B2

(12) United States Patent
Ward et al.

(10) Patent No.: US 8,813,444 B2
(45) Date of Patent: Aug. 26, 2014

(54) CONSTRUCTION TECHNIQUE FOR ATTACHING FINISHING ELEMENTS AND BUILDING STRUCTURE RESULTING THEREFROM

(71) Applicant: James Hardie Technology Limited, Dublin (IE)

(72) Inventors: Jason Ward, Redlands, CA (US); Kevin O'Leary, Covina, CA (US); Pete Ziminski, Brookfield, IL (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 13/682,254

(22) Filed: Nov. 20, 2012

(65) Prior Publication Data

US 2013/0125485 A1 May 23, 2013

Related U.S. Application Data

(60) Provisional application No. 61/563,461, filed on Nov. 23, 2011.

(51) Int. Cl.
*E06B 1/04* (2006.01)

(52) U.S. Cl.
USPC ..... 52/213; 52/210; 52/717.01; 52/718.01; 52/745.15

(58) Field of Classification Search
USPC ..... 52/167.1, 204.1, 210, 213, 204.5, 52/745.15, 288.1, 716.1, 717.01, 52/718.01–718.04, 718.06, 717.1
See application file for complete search history.

(56) References Cited

U.S. PATENT DOCUMENTS

| | | | | |
|---|---|---|---|---|
| 2,818,947 | A * | 1/1958 | Goldberg | 52/211 |
| 4,569,171 | A * | 2/1986 | Kuhr et al. | 52/242 |
| 6,219,980 | B1 * | 4/2001 | Peck, Jr. | 52/288.1 |
| 6,293,061 | B1 * | 9/2001 | Horak, Jr. | 52/213 |
| 6,354,049 | B1 | 3/2002 | Bennett | |
| 6,895,718 | B2 * | 5/2005 | Moffatt | 52/204.55 |
| 7,028,436 | B2 | 4/2006 | Bezubic | |
| 7,454,865 | B2 * | 11/2008 | Kerscher | 52/204.1 |
| 2007/0125013 | A1 * | 6/2007 | Prince | 52/204.1 |
| 2009/0205262 | A1 * | 8/2009 | Andrew | 52/26 |
| 2011/0179733 | A1 * | 7/2011 | Picken | 52/242 |
| 2011/0192102 | A1 | 8/2011 | Cottier et al. | |

OTHER PUBLICATIONS

Louisiana Pacific Dealer Event in Chicago Picture 1, Jul. 2012.
Louisiana Pacific Dealer Event in Chicago Picture 2, Jul. 2012.
Louisiana Pacific Dealer Event in Chicago Picture 3, Jul. 2012.
Non-Final Office Action, U.S. Publication No. 2011/0192102, dated Apr. 30, 2012, 8 pages.
Final Office Action, U.S. Publication No. 2011/0192102, dated Sep. 19, 2012, 8 pages.
Non-Final Office Action, U.S. Publication No. 2011/0192102, dated Jan. 16, 2013, 6 pages.

* cited by examiner

*Primary Examiner* — Brian Glessner
*Assistant Examiner* — Brian D Mattei
(74) *Attorney, Agent, or Firm* — Knobbe Martens Olson & Bear, LLP

(57) ABSTRACT

A system for attaching finishing elements to building structures without conventional structural sheathing is provided. The system includes attaching at least one thin, flat strip of nailable reinforcement member such as a metal strapping directly to the framing of a building structure. The finishing elements are then attached to the reinforcement members via a plurality of fastening tabs. The reinforcement members are in direct contact with the framing and configured to provide structural support and increase wind load resistance of the finishing element attached thereto.

14 Claims, 14 Drawing Sheets

CONSTRUCTION TECHNIQUE FOR ATTACHING FINISHING ELEMENTS AND BUILDING STRUCTURE RESULTING THEREFROM

CROSS-REFERENCE TO RELATED APPLICATIONS

This application claims the benefit of priority under 35 U.S.C. §119(e) of U.S. Provisional Application No. 61/563,461 filed on Nov. 23, 2011, the entirety of which is incorporated herein by reference.

BACKGROUND OF THE INVENTION

1. Field of the Invention

The present application is directed to building construction techniques, and more particularly to methods of attaching building finishing elements such as trim boards, fascia boards, and soffits to a building structure.

2. Description of the Related Art

In conventional modern construction, finishing elements, and in particular, trim boards such as HardieTrim® board, are often installed on the exterior surface of a building structure to provide a decorative finish. For example, trim boards can be applied to corners, sides of windows and doors, and top and bottom edges of the structure. The trim boards can be attached by screw or nail fastening to the building structure or, more desirably, by attachment via concealed fasteners, such as trim tabs. The concealed trim tabs are typically flat tabs extending outwardly from the edge of the trim board and configured to fasten to a sheathing in a manner that they are concealed from view. The sheathing is a structural insulating layer of material attached to the frame of the building structure. The sheathing is often ⅜" to ⅝" thick and typically covers the entire exterior of a building structure's frame. The sheathing can be made from a variety of different materials such as plywood and oriented strand board (OSB), and generally can provide an appropriate backing for fastening the concealed trim tabs.

Certain building constructions, however, particularly those in the southern regions of the United States, are constructed without any form of sheathing. Additionally, in some building structures, the building may alternatively be insulated with a rigid foam sheathing made from material such as expanded polystyrene (EPS), extruded polystyrene (XPS), and/or polyisocyanurate, and without the inclusion of a conventional structural sheathing made from plywood or OSB. It is difficult to attach concealed fasteners such as trim tabs to these types of building constructions because there is very little support surface for attachment. As a result, there is an ongoing challenge when using concealed fasteners to install finishing elements such as trim boards to building structures constructed without conventional structural sheathing.

In view of the foregoing, there is therefore a need for an improved technique and system for attaching finishing elements such as trim boards, fascia boards, and soffits to building structures, particularly those constructed without conventional structural sheathing. Such a system would be particularly suitable for the installation of finishing elements on homes that are constructed with exterior siding and without a structural sheathing layer.

SUMMARY OF THE INVENTION

The present application relates to a system and method for attaching building finishing elements such as trim boards and other construction materials to a building structure such as a residential or commercial building. According to some embodiments described herein, the method includes the steps of attaching a reinforcement member, preferably made of steel, to the frame of a building structure, and fastening the finishing elements to the reinforcement member via fastening tabs installed on the finishing elements, resulting in the finishing element being fixedly attached to the building structure. The reinforcement member is preferably positioned between the building frame and the finishing element and serves as a backing for fastening the fastening tabs thereto. The framing can be made of wood, steel, or other material.

In accordance with one preferred embodiment, the reinforcement member is sized slightly larger than the fastening tabs in order to create a sufficient fastening surface to attach the fastening tabs to the reinforcement member. The reinforcement member, preferably made of steel, provides a sufficient support surface for the fastening tabs, thus eliminating the need for attaching the fastening tabs to a structural sheathing. In other embodiments, the reinforcement member can be made of material other than steel. Upon installation of the finishing elements and building walls or siding, the fastening tabs and fasteners are concealed from view. As such, finishing elements can be installed with consistency on building structures with or without sheathing.

In accordance with another embodiment, the reinforcement member has a slightly larger area than that of the finishing elements. In yet additional embodiments, the building frame, the reinforcement member, or both have recesses in which the finishing elements and fastening tabs are mounted such that the finishing elements lie generally flush with desired building features, such as windows or doors.

In accordance with yet another embodiment, the present disclosure provides a method of installing a trim member on a building structure having a framing. The method includes attaching at least one reinforcement member directly to the framing. The reinforcement member preferably comprises a thin, flat strip of nailable metal. The method further includes installing the trim member on the framing by attaching one or more fastening tabs disposed on the trim member to the at least one reinforcement member. The fastening tabs are preferably attached to the at least one reinforcement member in a manner such that at least a portion of each fastening tab is concealed from view when the trim member is installed on the framing. In some implementations, the reinforcement member comprises a steel strapping.

In accordance with yet another embodiment, the present disclosure provides a building finishing element installation assembly comprising a building finishing element having an interior and an exterior surface, and a plurality of tabs attached to the interior surface of the building finishing element in a manner such that a portion of each tab extends outwardly from the lateral edges of the building finishing element. The assembly further comprises a reinforcement member comprising a thin, nailable strip of steel. In one embodiment, the reinforcement member comprises a plurality of spaced apart indents or protrusions formed thereon to increase the stiffness of the reinforcement member. The reinforcement member is adapted to be attached to the tabs of building finishing element in a manner such that the interior surface of the building finishing element is disposed adjacent the steel reinforcement member and the exterior surface of the trim board faces outwardly.

In accordance with yet another embodiment, the present disclosure provides a reinforcing member for increasing wind load resistance of a building finishing element. The reinforcing member comprises a thin, elongate body having a thickness between 18 and 24 gauge, or preferably 20 gauge, a plurality of spaced apart indentations extending along a longitudinal axis of the body, and attachment points disposed along the elongate body, wherein each of the attachment points is configured to receiver a fastener.

DETAILED DESCRIPTION OF THE PREFERRED EMBODIMENT

Figure 1:
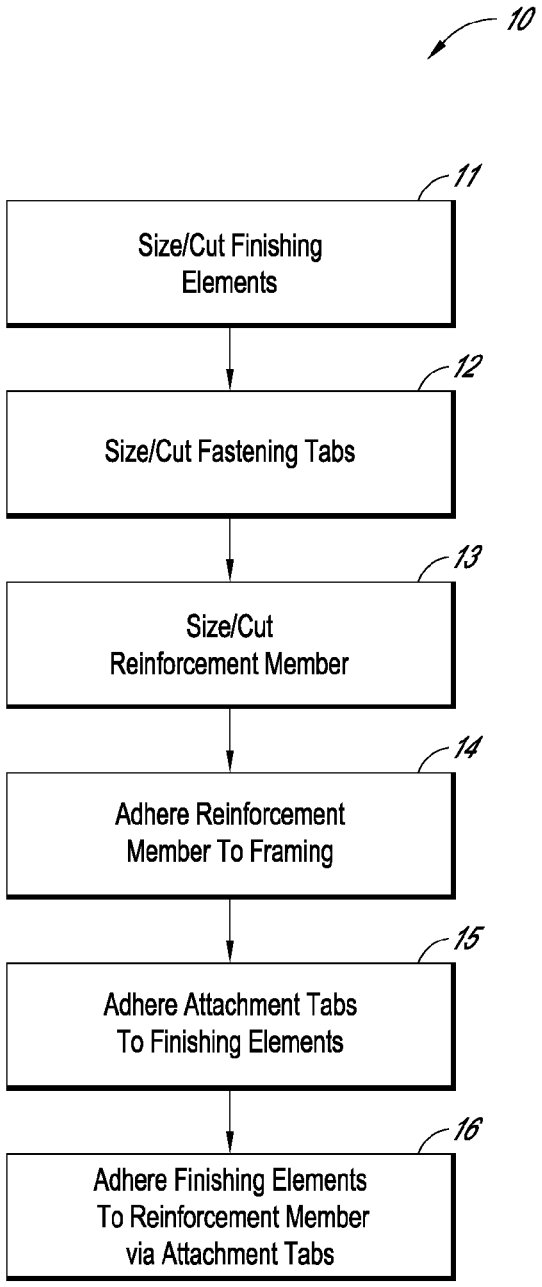
FIG. 1 is a flowchart illustrating one preferred embodiment of a construction process for attaching finishing elements to a building structure without the use of sheathing.

References will now be made to the drawings wherein like numerals refer to like parts throughout. One embodiment described herein includes a building construction system and method for attaching building finishing elements such as trim boards, fascia boards, and soffits to a building structure. FIG. 1 shows an example of a construction method or process 10 according to one preferred embodiment in which a finishing element is attached to a building structure without requiring the use of sheathing. The process 10 can begin by dimensioning, sizing, and forming or cutting a plurality of finishing elements, for use on a building structure (block 11). The finishing elements can provide a decorative trim around the building's features, such as windows, doors, and corners, and are sized to compliment the building's features.

The process 10 next includes dimensioning, sizing, forming or cutting a plurality of fastening tabs for use with the finishing elements (block 12). The fastening tabs are used to connect the finishing elements to a reinforcement member to be described in greater detail below. The size and configuration of the fastening tabs can vary depending on the application. The fastening tabs are sized such that a portion of the fastening tab will be able to connect to the finishing element and an adjacent portion of the fastening tabs will be able to connect to the reinforcement member. In one implementation, the fastening tabs have a flat, rectangular configuration having a width of about 4 inches, preferably 3.5 inches. In another implementation, the fastening tab is preferably 3.5 inches by 2 inches, and the overall thickness of the fastening tab is between 16 to 20 gauge, preferably 18 gauge. In yet another implementation, the length of the fastening tab is about 3 inches and the width is about 2 inches with a 0.63 inch thickness. In this configuration, the fastening tabs are sized such that they can be used to attach a single finishing element to a single piece of reinforcement member. Preferably, each fastening tab is sized to have at least a minimum area that can accommodate at least four staples on the portion of the fastening tab to be connected to the finishing element and can accommodate at least a screw or pin on the portion of the fastening tab to be connected to the reinforcement member. In another arrangement, the fastening tabs can be angled and sized to attach multiple finishing elements to the reinforcement member, for example for use around a corner of the building framing.

Referring to FIG. 1, the process 10 further includes configuring a plurality of reinforcement members for use with the finishing elements and fastening tabs (block 13). The reinforcement members are preferably flat and thin strips of metal that are nailable and configured to support the weight of the trim and provide sufficient wind load resistance. The reinforcement member can be made of a metal material such as iron, steel, aluminum, tin, or nickel; a metal alloy; wood, fiberboard, vinyl or a laminate composite; plastic such as acrylic or ABS; or some combination therefrom.

Figure 2A:
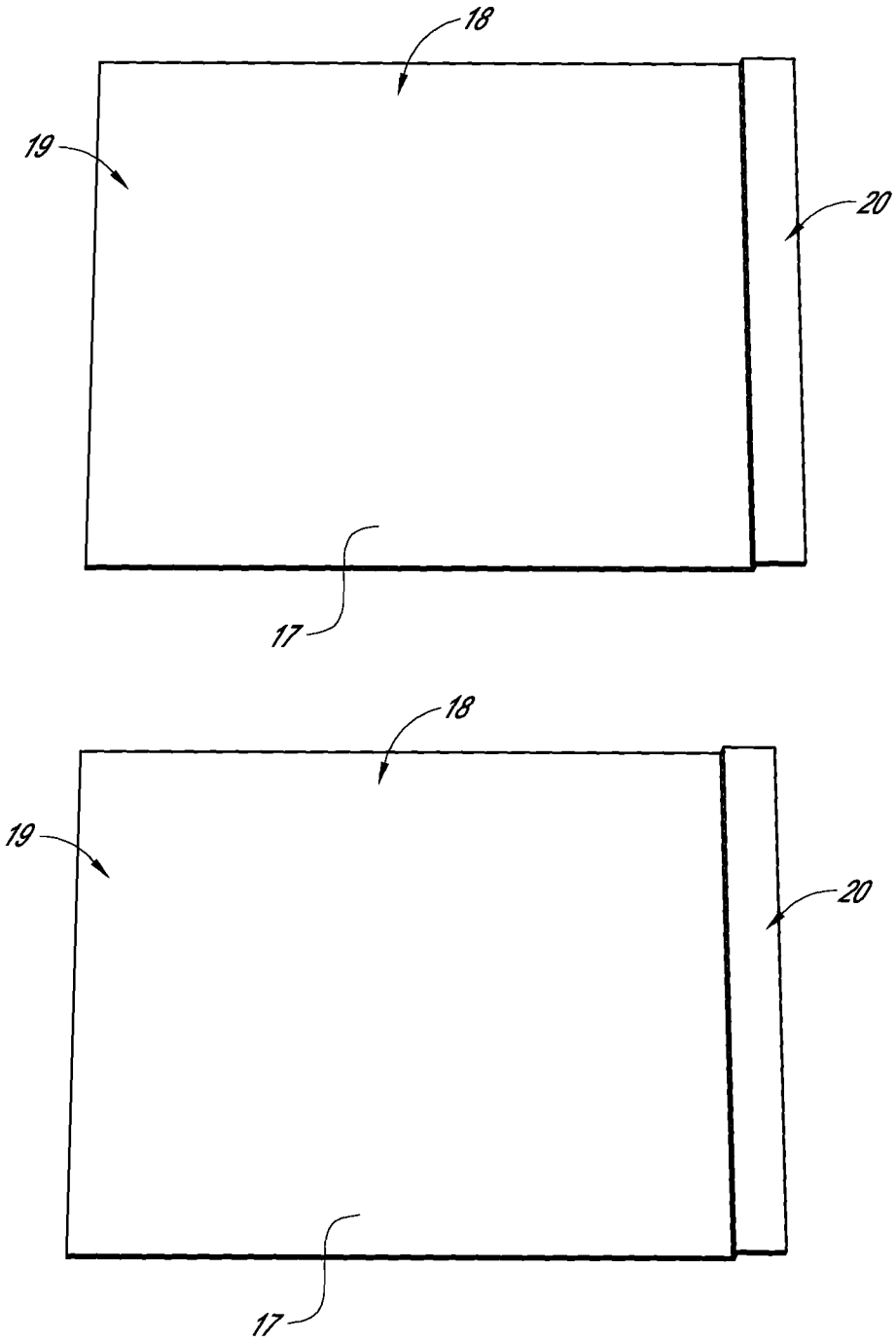
FIGS. 2A and 2B illustrate embodiments of a reinforcement member.
Figure 2B:
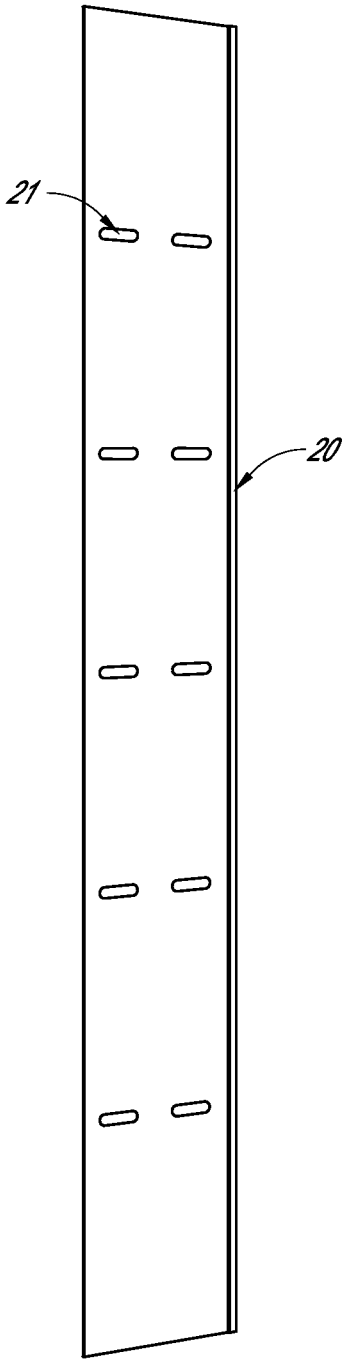

The size of the reinforcement member can vary depending on the application. In one preferred embodiment, the reinforcement member has a thin, elongate rectangular configuration having a width between 3 to 6 inches and a length between 2 and 4 feet. In one implementation, the reinforcement member has a width 4 or 6 inches. In another implementation, the reinforcement member has a width of 4 inches and a length of 3 feet. In another preferred embodiment, the reinforcement member is nailable and has a thickness of between 18 to 24 gauge. FIGS. 2A and 2B show illustrations of reinforcement member 17 that has been sized and formed for use in the construction method according to certain embodiments. In some implementations, the reinforcement member can be a thin strip of metal or a strapping. In FIG. 2A, the reinforcement member 17 is preferably sized such that multiple pieces of reinforcement member can be used for attaching each finishing element. The reinforcement member is preferably sized such that the reinforcement member length and width is smaller than the length and width of the corresponding finishing element. The reinforcement member 17 has a front surface 18 and a back surface 19, the front surface configured to provide a fastening surface for fastening tab to be later mated. The reinforcement member can be sized such that at least a portion of the fastening surface of the reinforcement member has a length or width dimension that is larger than at least a portion of the length or width dimension of the fastening tab to be secured to the reinforcement member. As the finishing elements are not load bearing structures, the reinforcement member need only be sized large enough such that the fastening tabs have a sufficient fastening surface to attach to the reinforcement member.

In another embodiment, shown in FIG. 2B, the reinforcement member 17 can be sized such that a single piece of reinforcement member can be used for each finishing element or multiple finishing elements. In this embodiment, the reinforcement member is dimensioned such that the front surface is as large as or larger than the finishing element that the reinforcement member will support so as to provide a sufficient border for adhering the fastening tabs as well as for supporting the finishing element. In the embodiment shown in FIG. 2B, the reinforcement member 17 comprises a plurality of spaced apart indents 21 extending longitudinally along the reinforcement member. The indents 21 are configured provide sufficient stiffness to the reinforcement member to support the finishing element. In one implementation, there are two indents for every six inches of reinforcement member. In one example, the reinforcement member can be 3 feet by 4 inch 20 Gauge galvanized steel having a ¼ inch hem on one side 20. In another example, the reinforcement member can be 3 feet by 6 inch 20 gauge galvanized steel.

Figure 3:
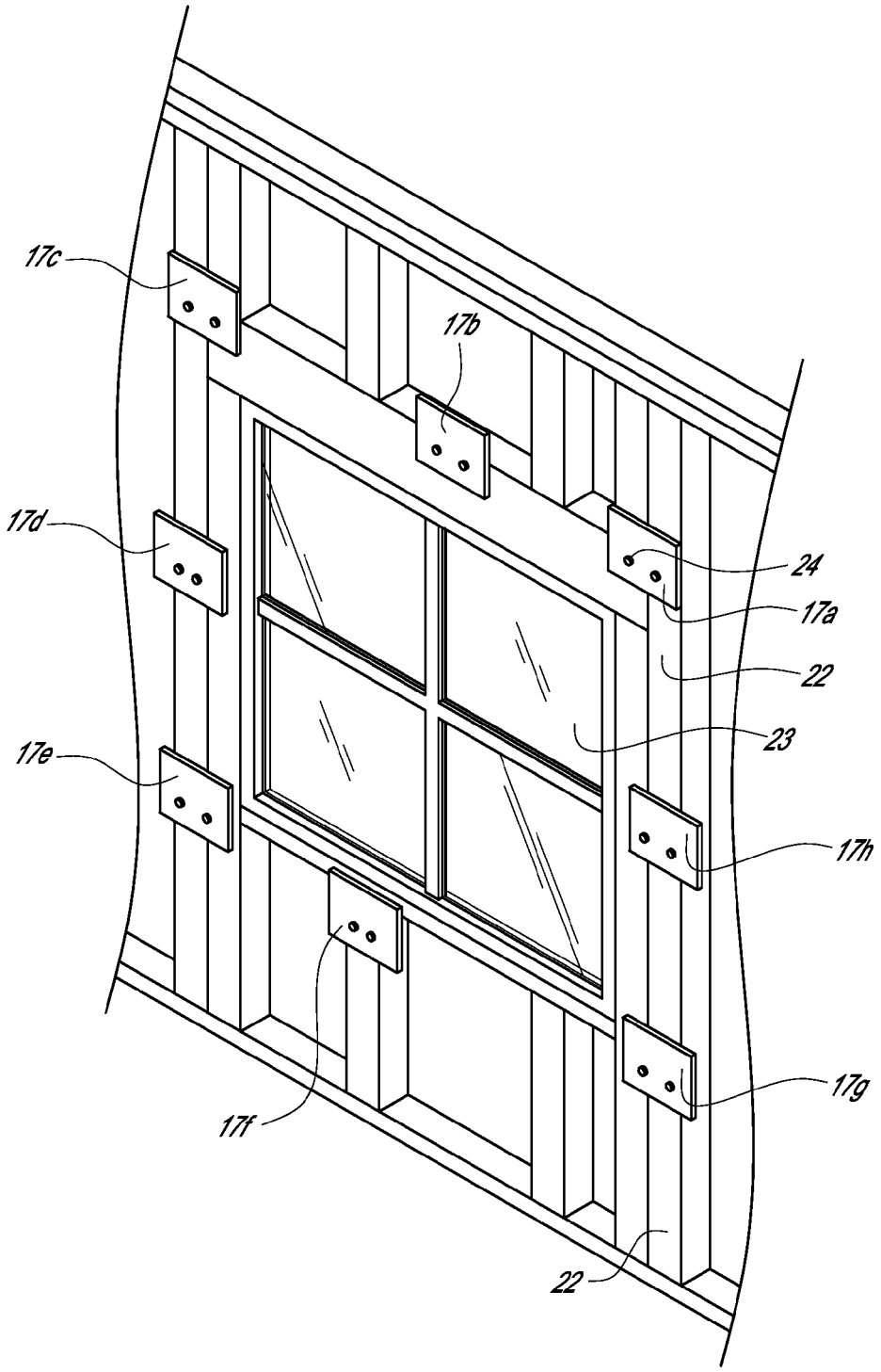
FIG. 3 illustrates a building frame with an installed window and a fastened reinforcement member for adhering building finishing elements according to one embodiment.

Referring back to the process 10 of FIG. 1, each individual reinforcement member can be directly attached to the framing of a building structure (block 14). FIG. 3 shows one arrangement in which the reinforcement members 17*a*, 17*b*, 17*c*, 17*d*, 17*e*, 17*f*, 17*g*, 17*h* can be positioned around the perimeter of a window 23 and mounted on the exterior surface of the framing 22 of a building structure using one or more connectors 24. In the illustrated arrangement, multiple pieces of the reinforcement member are strategically spaced around the perimeter of the window frame such that the corner pieces of reinforcement member, 17*a*, 17*c*, 17*e*, 17*g*, can later be used to fasten a plurality of fastening tabs from separate trim pieces. In this embodiment, the reinforcement member length and width may be sized smaller than the length and width of the corresponding finishing element. Such a configuration can be used to reduce the material demand and corresponding cost of the finishing installation. The reinforcement member is preferably spaced and located such that the reinforcement member pieces do not abut each other. In one preferred arrangement, additional pieces of reinforcement member, 17*b*, 17*d*, 17*f*, 17*h*, are preferably positioned and adhered to the building framing such that the fastening tabs upon mating will be 16 inches on center.

Figure 4:
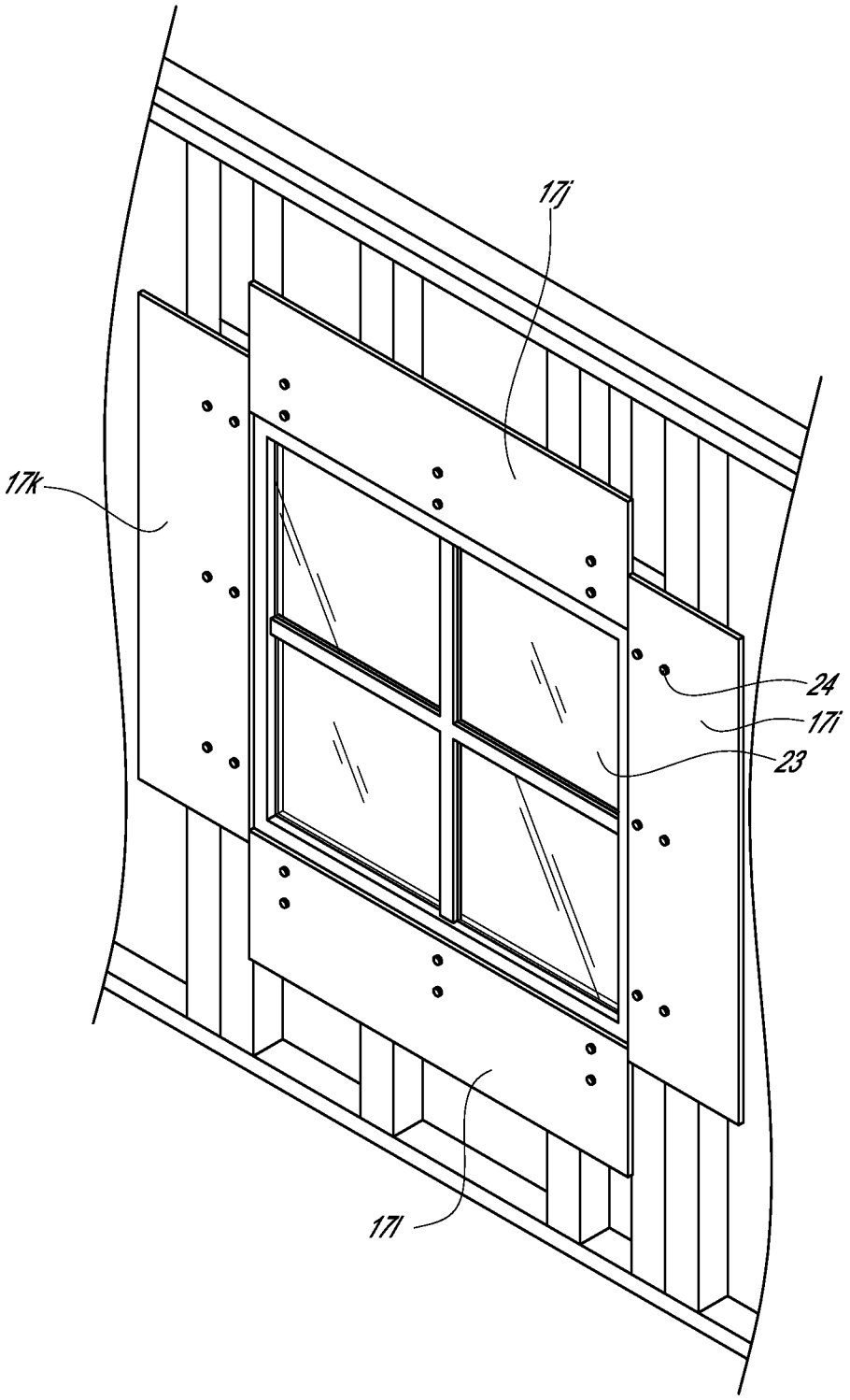
FIG. 4 illustrates a building frame with an installed window and a fastened reinforcement member for adhering building finishing elements according to another embodiment.

FIG. 4 shows an alternative arrangement in which the reinforcement members 17*i*, 17*j*, 17*k*, 17*l* can be positioned around a window 23 and attached directly to the exterior surface of the framing of a building structure using one or more connectors 24. A gap of ½ inch to 1 inch of space is preferably placed between the window edge and the reinforcement member. In one preferred arrangement, the reinforcement members are nailed to the building framing with 8d framing nails every 6 to 12 inches. In this embodiment, the reinforcement member can be constructed out of multiple pieces of material that abut each other as shown. In an alternative embodiment, the reinforcement member can be constructed out of a single piece of material (not illustrated). The larger reinforcement member can provide a larger mounting surface for the fastening tabs and therefore make the step of mounting the fastening tabs an easier task. In this arrangement, the placement of the fastening tabs would not have to be exact as the larger reinforcement member can accommodate several mounting locations for the fastening tabs.

The reinforcement members, such as strapping, can be coupled to the building framing via connectors 24 resulting in the reinforcement members being fixedly attached to the building structure as shown in FIGS. 3 and 4. The connectors 24 can include nails, staples, pins, rivets, screws, anchors, clasps, bolts, bucklers, clips, snaps, and other types of fasteners as in known to those of skill in the art. The reinforcement member can be attached to the building frame through a single connector or multiple connectors. The connectors can include a plurality of fastening elements on a single connector. A single connector with a plurality fastening elements, for example, can be used to attach multiple pieces of reinforcement member to the building frame (not illustrated). The connectors can include one or more types of fasteners in and among the elements of the system. In some embodiments, a single type of fastener can be used to attach the elements of the system to the building structure. In other embodiments, a plurality of types of fasteners can be used to adhere the elements of the system to the building structure, including multiple types of fasteners applied to an individual element of the system.

Figure 5:
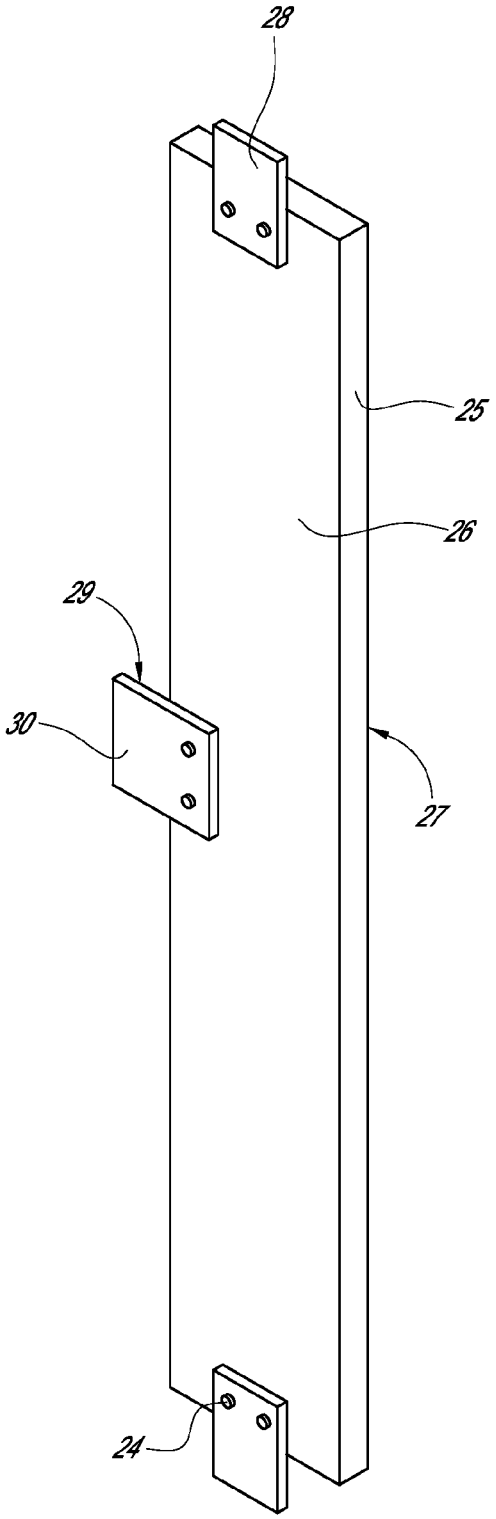
FIG. 5 illustrates a finishing element with attached fastening tabs for installation around a window according to one embodiment.

Referring back to FIG. 1, the process 10 further includes attaching the fastening tabs to the finishing element (block 15). FIG. 5 illustrates one or more fastening tabs 28, having a front side 29 and a backside 30, can be attached to the finishing elements 25 using one or more of the connectors 24. The fastening tabs 28 can be secured to the interior surface 26 of the finishing element through connectors 24 fastened on the backside 30 of the fastening tabs such that the front side 29 of the fastening tabs and the interior surface 26 of the finishing element are mated. The fastening tabs can be attached to the finishing element in a spaced apart relationship, preferably 16 inches on center. The finishing elements 25 can include an interior surface 26 and an exterior surface 27. The interior surface 26 can be installed in an orientation facing or adjacent to the frame of the building. In other arrangements, the finishing elements can have a different shape, such as a spiral geometry, wherein an interior and exterior surfaces cannot be defined or are not included (not illustrated). In other embodiments, the fastening tabs can be attached to the exterior surface 27 of the finishing elements 25, to provide, for example, a decorative finish. The fastening tabs can be attached to the finishing elements such that a portion of the fastening tab 28 extends beyond an edge or boundary of the finishing elements 25. In some embodiments, the fastening tabs can be attached to the finishing elements such that they do not extend past a portion of the finishing elements, for example, the fastening tabs can be placed into or behind a hole in the finishing element (not illustrated). In some configurations, more than one fastening tab can be attached adjacent to a single edge or boundary of the finishing elements (not illustrated).

Figure 6:
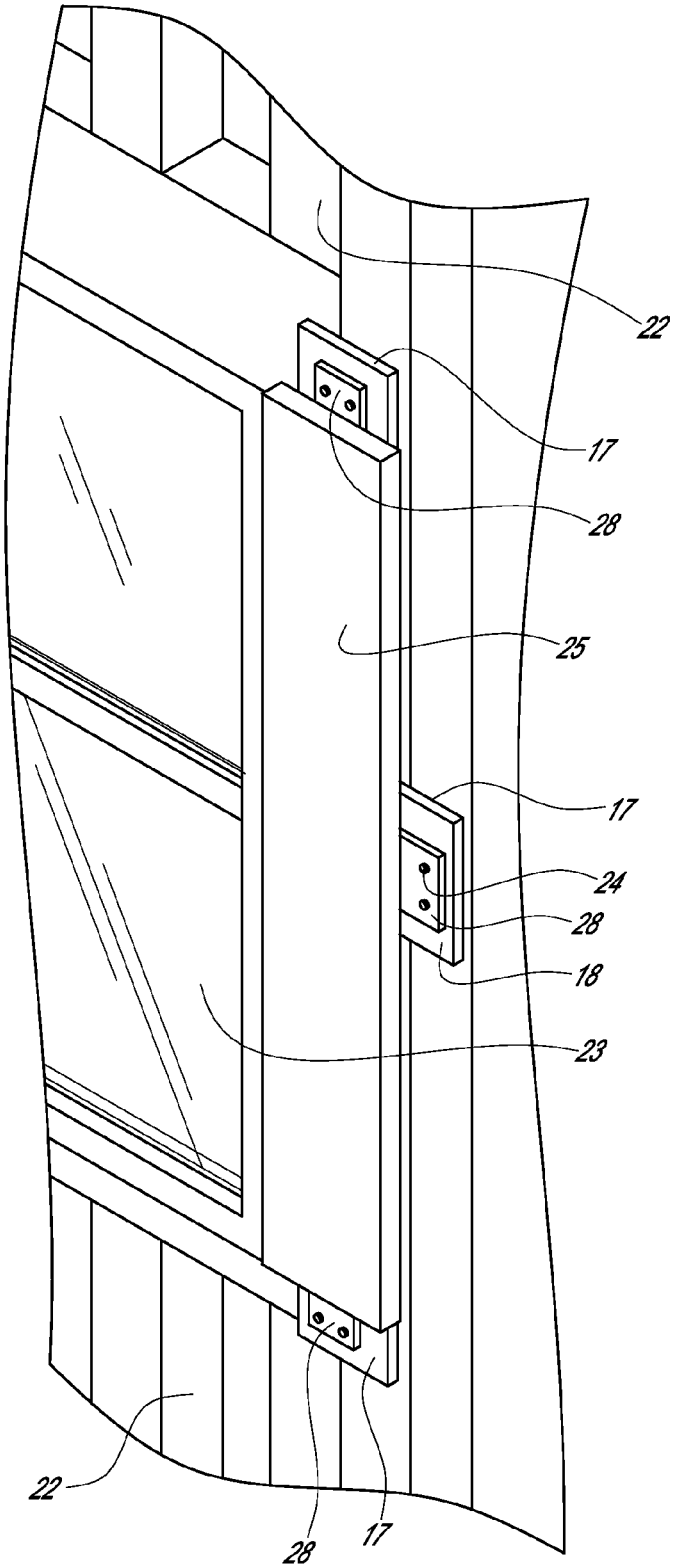
FIG. 6 illustrates a building frame with an installed window, reinforcement member and trim board with attached fastening tabs according to one embodiment.

Referring to FIG. 1, process 10 further includes attaching the finishing elements to the reinforcement member via the fastening tabs (block 16). FIG. 6 illustrates one finishing element 25 coupled with fastening tabs 28 attached to the reinforcement member 17 installed around the perimeter of a window 23. Advantageously, the reinforcement member 17 eliminates the need for adhering the fastening tabs to sheathing and in some embodiments, providing window load capabilities. In one preferred embodiment, each fastening tab is fastened to the reinforcement member by a nail at 16 inches on center and each fastening tab is fastened to the finishing element by four staples (not illustrated). The reinforcement member can be fastened to the building framing 22 and the fastening tabs can in turn be fastened to the reinforcement member, resulting in the finishing element being fixedly attached to the building structure. In such a configuration, the reinforcement member can be positioned between the finishing element and the building framing of the building structure and can serve as a backing for fastening the fastening tabs thereto. In some embodiments, once the building finishing elements and the exterior walls or siding are installed (not illustrated), the fastening tabs and/or the reinforcement member can be concealed from view. In some embodiments, the building frame and/or the reinforcement member can include a recess (not illustrated) in which the finishing elements and fastening tabs can be mounted therein such that finishing elements lie generally flush with the window.

In one preferred arrangement, the finishing elements and the fastening tabs are sized prior to the adhesion of the fastening tabs to the finishing elements. In other arrangements, the fastening tabs can be attached to the finishing elements before the fastening tabs and/or finishing elements are sized (not illustrated). In one example, the fastening tabs are attached to the finishing elements and an excess of the fastening tabs is removed. In another preferred arrangement, the reinforcement member sizing step preferably occurs prior to the step of attaching the reinforcement member to the building frame. However, in other arrangements (not illustrated), the reinforcement member can be attached to the building frame prior to the reinforcement member being sized. In one example, the reinforcement member may be attached to the building and excess reinforcement member can be removed after the reinforcement member is coupled to the building. The steps of sizing and cutting the finishing elements, sizing and cutting the fastening tabs, and sizing and cutting the reinforcement member may occur concurrently or simultaneously, and in any order. In one preferred embodiment, the fastening tabs, finishing elements, and reinforcement member are all sized and cut concurrently or sequentially before any of the attachment steps of the process 10 are performed. In another arrangement, the step of attaching the reinforcement member to the framing may occur any time before the finishing elements are adhered to the reinforcement member via the fastening tabs and after the reinforcement member is sized.

Figure 7:
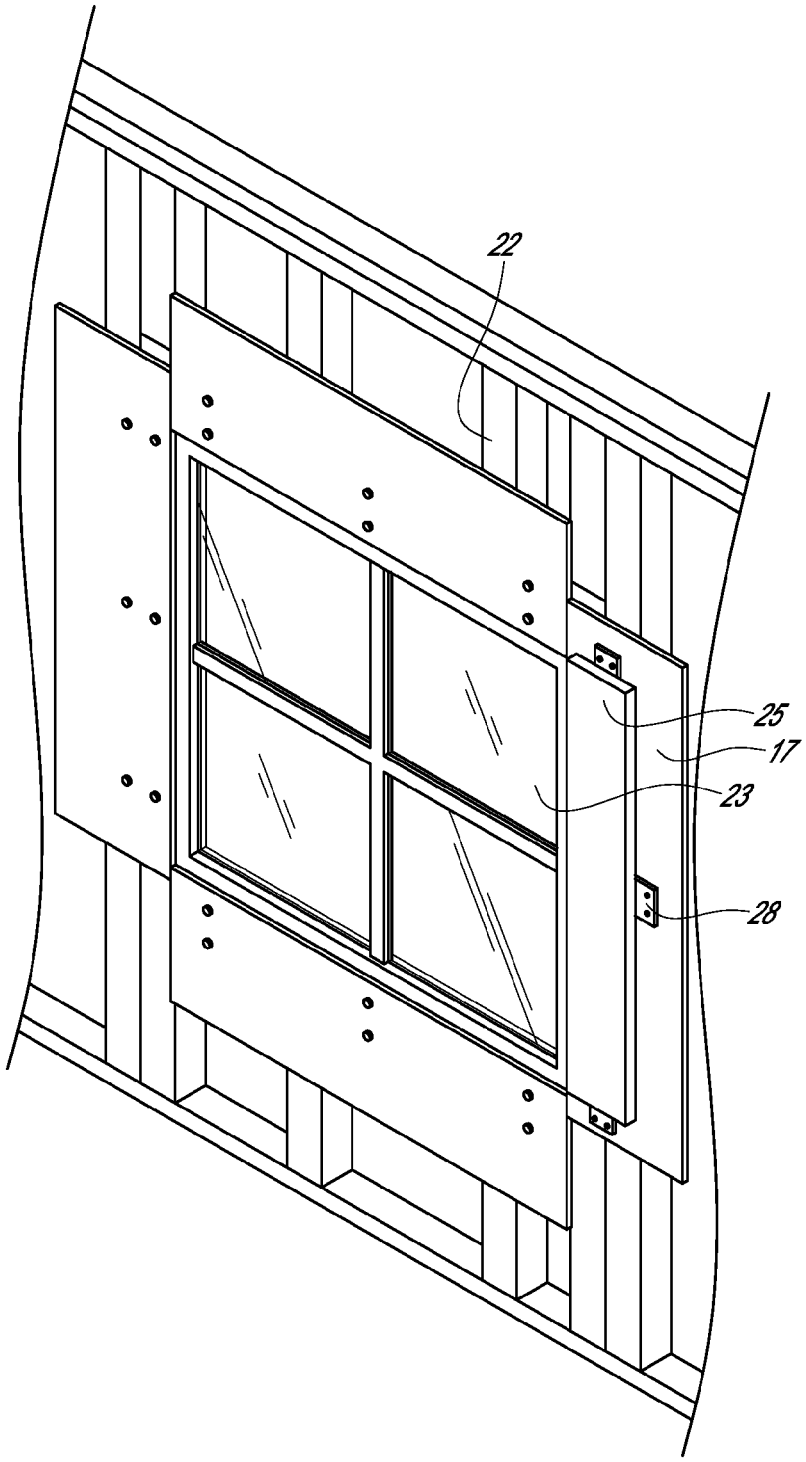
FIG. 7 illustrates a building frame with an installed window, reinforcement member and trim board with adhered fastening tabs according to another embodiment.

FIG. 7 illustrates an alternative embodiment of a finishing element 25 installed around a window 23. In this embodiment, the reinforcement member has been sized such that it is larger than the finishing element with the coupled fastening tabs. This arrangement can allow for easier placement of the finishing element as there are multiple potential attachment points on the reinforcement member element.

Figure 8:
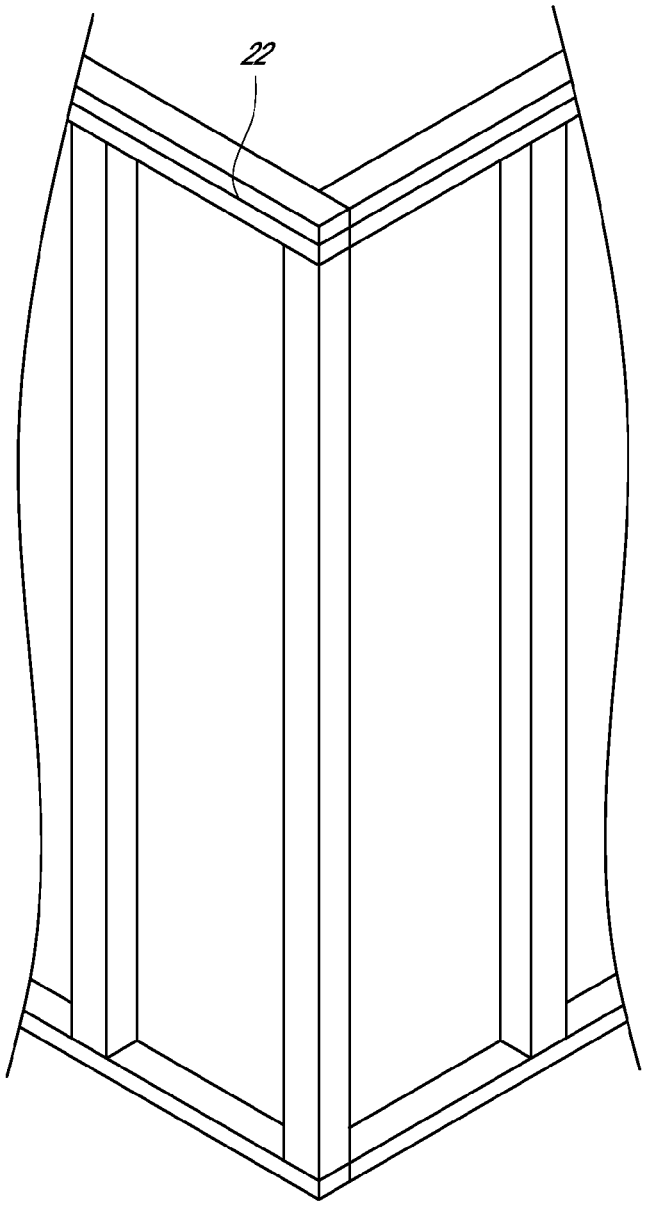
FIG. 8 illustrates a corner of a building frame prior to the attachment of any finishing elements.

FIGS. 8-11 depict an alternative embodiment of the building construction system for installation of finishing elements around a corner of the building frame. FIG. 8 depicts a corner of the building frame 22 prior to the attachment of any finishing elements. The building frame 22 alone, without sheathing or a reinforcement member, provides an insufficient fastening surface for mounting the fastening tabs, as illustrated in the figure.

Figure 9:
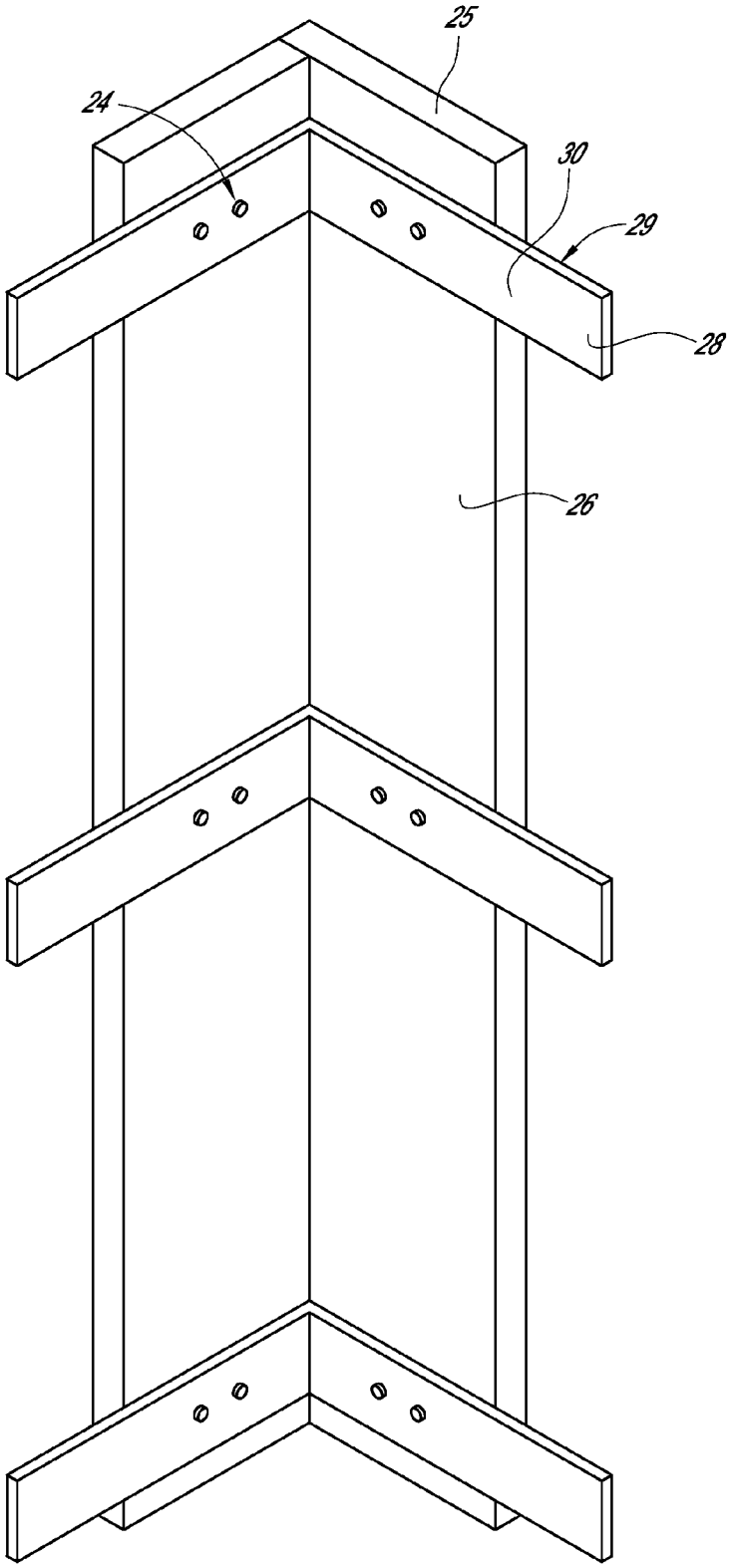
FIG. 9 illustrates a trim board with adhered fastening tabs for installation around a corner according to one embodiment.

FIG. 9 illustrates one embodiment of fastening tabs 28 attached to finishing elements 25 for use around a corner of a building frame. As shown in the figure, a single fastening tab 28 can be used to fasten portions of a plurality of finishing elements 25 together. In such an arrangement, each fastening tab 28 can be secured to the interior surface 26 of one or more finishing elements 25. Connectors 24 are fastened on the backside 30 of the fastening tabs 28 such that the front side 29 of the fastening tabs and the interior surface 26 of each finishing element are mated. Such an arrangement can allow for a plurality of finishing elements to be fixed together and installed simultaneously. In such an embodiment, the coupled finishing elements can be fixed together such that the finishing elements are adjacent. In other arrangements, the coupled finishing elements can be bonded and spaced apart (not illustrated).

Figure 10:
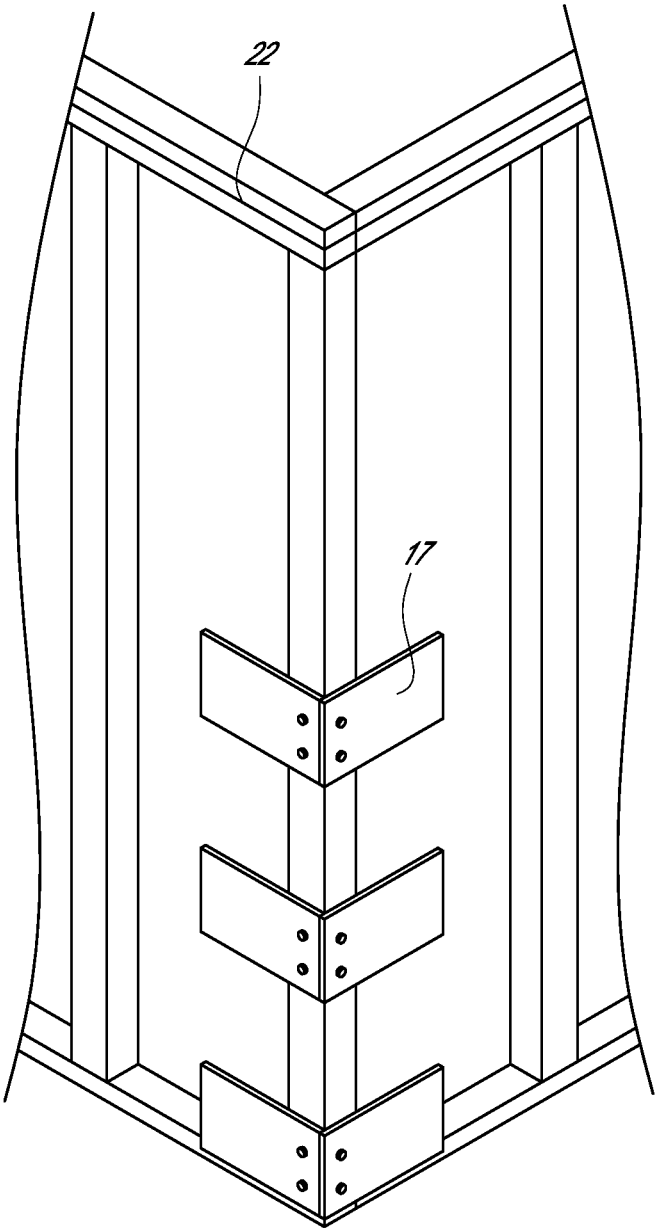
FIG. 10 illustrates a corner of a building frame and a fastened reinforcement member for adhering building finishing elements according to one embodiment.
Figure 11:
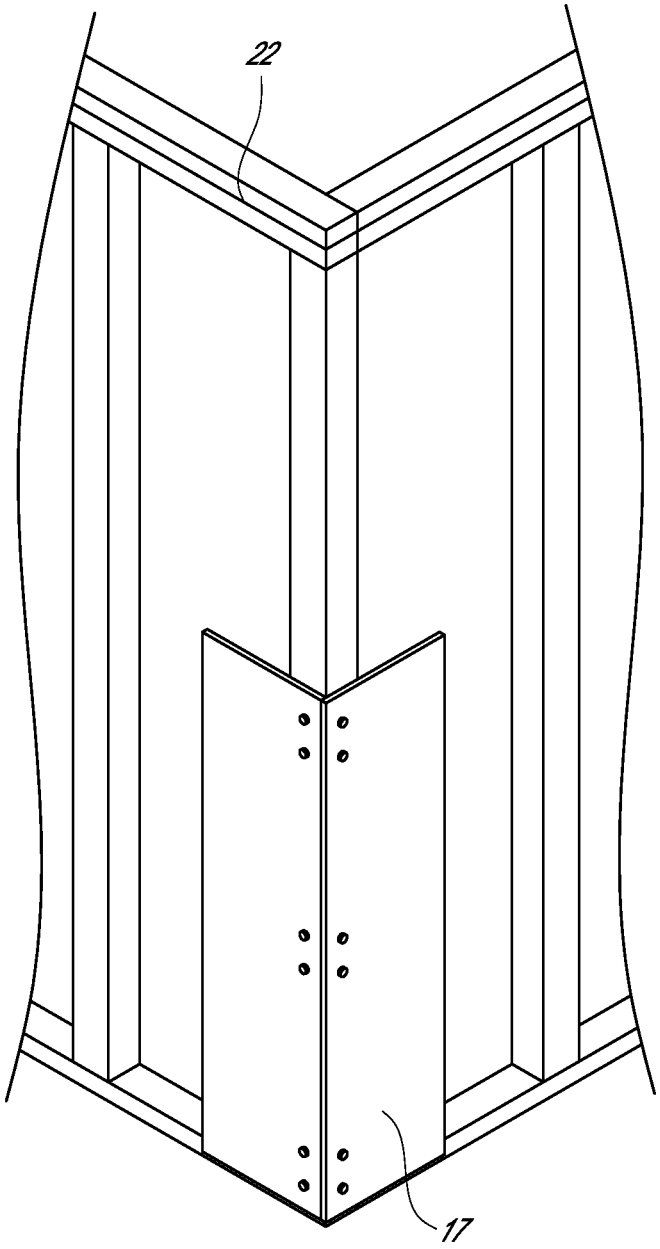
FIG. 11 illustrates a corner of a building frame and a fastened reinforcement member for adhering building finishing elements according to another embodiment.

FIG. 10 illustrates one embodiment of multiple pieces of reinforcement member 17 attached to the building frame 22 for use around a corner. In one preferred arrangement, the reinforcement member is sized such that mating fastening tabs will be 16 inches on center. FIG. 11 illustrates an alternative arrangement of multiple pieces of reinforcement member 17 attached to the building frame 22 for use around a corner. In this arrangement, the reinforcement member is sized to abut each other and provide a more convenient mounting surface for mating fastening tabs with multiple potential attachment locations.

Figure 12:
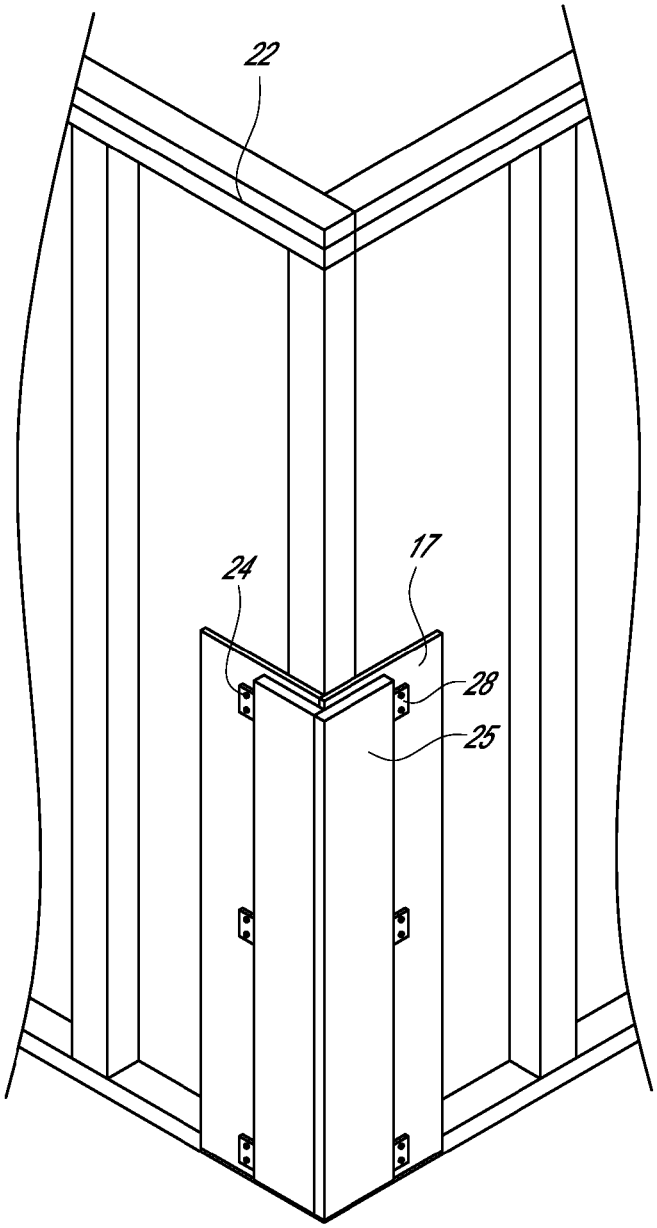
FIG. 12 illustrates a corner of a building frame with a fastened reinforcement member and trim board with adhered fastening tabs according to one embodiment.

FIG. 12 illustrates an embodiment of finishing elements 25 installed around a corner via reinforcement member 17. In the illustrated arrangement, the building construction system can include one or more sections of the reinforcement member 17, one or more finishing elements 25, one or more fastening tabs 28, and one or more connectors 24. The reinforcement member can be fastened to the building framing and the fastening tabs can in turn be fastened to the reinforcement member, resulting in the finishing element being fixedly attached to the corner of the building structure as shown in the figure. In such a configuration, the reinforcement member can be positioned between the finishing element and the corner of the building framing and can serve as a backing for fastening the fastening tabs thereto. In some embodiments, once the building finishing elements and the exterior walls or siding are installed around the corner (not illustrated), the fastening tabs and/or the reinforcement member can be concealed from view.

Figure 13A:
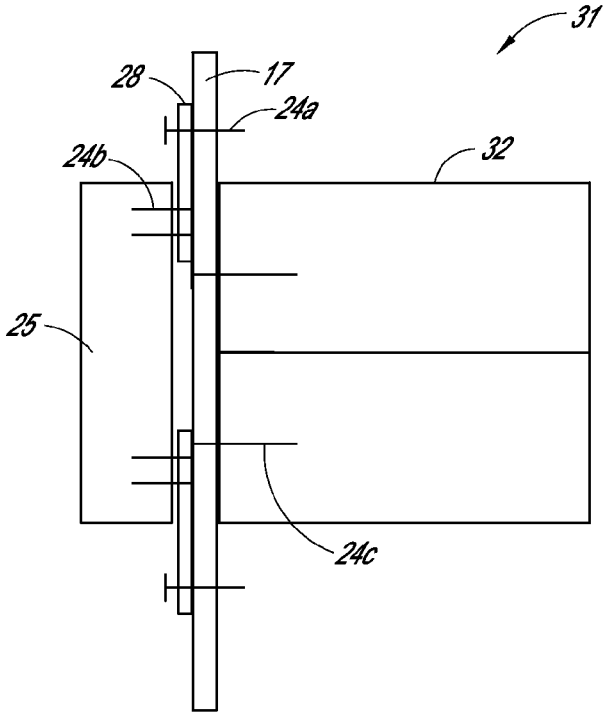
FIG. 13*a* illustrates a partial cross-sectional view of a structure including a trim board attached to a wood framing using a reinforcement member according to one embodiment.
Figure 13B:
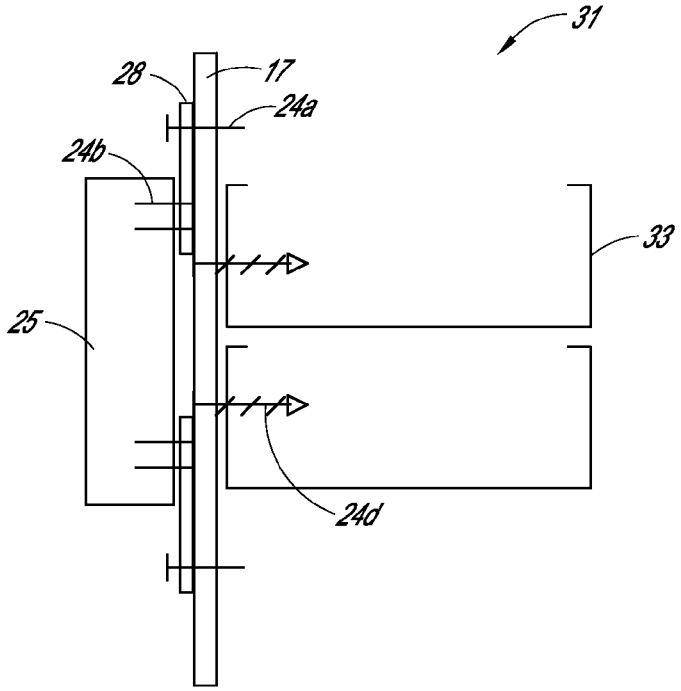
FIG. 13*b* illustrates a partial cross-sectional view of a structure including a trim board attached to a metal framing using a reinforcement member according to one embodiment.

FIG. 13A shows a schematic illustration of a partial cross-sectional view of the finishing installation assembly 31 according to a preferred embodiment. As shown in FIG. 13A, the assembly can include a finishing element 25 such as a trim board, a plurality of fastening tabs 28, a reinforcement member 17, such as a metal strapping, and connectors 24*a* attaching the fastening tabs 28 to the reinforcement member 17, connectors 24*b* adhering the fastening tabs 28 to the finishing element 25, and connectors 24*c* attaching the reinforcement member 17 to a wooden framing 32. FIG. 13B is a schematic illustration of an additional partial cross-sectional view of the finishing element installation assembly 10 according to another preferred embodiment. In this embodiment, the assembly is substantially the same as the system shown in FIG. 13A except that the framing is made of steel and it uses steel specific connectors 24*d* to attach the reinforcement member 17 to the steel framing 33.

The following chart illustrates testing results of windload testing per ASTM E330 of trim board systems installed according to preferred embodiments of the present invention as compared to trim boards installed using conventional systems. As shown in the chart, the trim board installation systems utilizing a steel reinforcement member for attachment can provide sufficient wind load capabilities and have consistent performance characteristics regardless of whether the framing is made of wood or steel. In one implementation, the reinforcement member comprises a thin steel reinforcement member having an ultimate pressure of 16 inches of $H_2O$ when used on a steel studded building frame with four staples fastening the fastening tabs to window trim elements and one pin adhering the fastening tab to the steel reinforcement member.

Traditional Sheathing Configurations

| | System | Fastener Spacing (in.) | Frame Type (S.G. or Thickness) | Fastener Type (screw, nail) | Fastener Placement | Fastener, L (in) | Fastener Penetration (in) | Ultimate Pressure (Inches of H2O) | Ultimate Pressure (psf) (mult in H2O by 5.2) | Design Pressure (psf) |
|---|---|---|---|---|---|---|---|---|---|---|
| Tabs attached to sheathing or Framing | Finish nails into stud - 16" OC, 2 nails at each location, 1 inch from edge of NT3 trim | 16 | SPF | Finishing nail | Into Stud | 2 | 1.25 | 24 | 129.26 | 43.09 |
| | Finish nails into OSB - 16" OC, 2 nails at each location, 1 inch from edge of trim | 16 | OSB | Finishing nail | Into OSB | 2 | 0.44 | 14 | 77.04 | 25.68 |
| | Finish nails into OSB - 8" OC, 2 nails at each location, 1 inch from edge of trim | 8 | OSB | Finishing nail | Into OSB | 2 | 0.44 | 30 | 160.24 | 53.41 |
| | Tabs into OSB - 16" OC, four staples fastening tab to trim. Two Siding nails fastening tabs to frame | 16 | OSB | Staples & 6d siding | Into OSB | 2 | 0.44 | 14 | 77.26 | 25.8 |
| | Tabs into OSB - 8" OC, four ¼" by ½" 18 gauge staples fastening tab to trim. 6d siding nail fastening tabs to frame | 8 | OSB | Staples & 6d siding | Into OSB | 2 | 0.44 | 12 | 66.64 | 22.21 |
| | Tabs into stud - 8" OC, four ¼" by ½" 18 gauge staples fastening tab to trim. 6d siding nail fastening tabs to frame | 8 | SPF | Staples & 6d siding | Into Stud | 2 | 1.9 | 32 | 170.64 | 56.88 |

Steel Reinforcement member Configurations

| | System | Fastener Spacing (in.) | Frame Type (S.G. or Thickness) | Fastener Type (screw, nail) | Fastener Placement | Fastener, L (in) | Fastener Penetration (in) | Ultimate Pressure (Inches of H2O) | Ultimate Pressure (psf) (mult in H2O by 5.2) | Design Pressure (psf) |
|---|---|---|---|---|---|---|---|---|---|---|
| Tabs attached to Steel Reinforcement member | Tabs into Steel Reinforcement member - 16" OC, installed sideways, four staples fastening tab to trim. One pin attaching tab to steel strap. | 16 | Steel Studs with 20 ga. Steel reinforcement member | Staples & pin | 20 ga. Steel reinforcement member | 2 | 0.44 | 16 | 87.66 | 29.2 |
| | Tabs into Steel Reinforcement member - 16" OC, installed sideways, four staples fastening tab to trim. One screw attaching tab to steel strap. | 16 | SPF Studs with 20 ga. Steel reinforcement member. | Staples & screw | 20 ga. Steel reinforcement member | ¾ | 0.44 | 16 | 87.66 | 29.2 |

The various devices, methods, procedures, and techniques described above provide a number of ways to carry out the described embodiments and arrangements. Of course, it is to be understood that not necessarily all features, objectives or advantages described are required and/or achieved in accordance with any particular embodiment described herein. Also, although the invention has been disclosed in the context of certain embodiments, arrangements and examples, it will be understood by those skilled in the art that the invention extends beyond the specifically disclosed embodiments to other alternative embodiments, combinations, sub-combinations and/or uses and obvious modifications and equivalents thereof. Accordingly, the invention is not intended to be limited by the specific disclosures of the embodiments herein.

What is claimed is:

1. A method of installing a trim member on a building structure having a framing comprising a plurality of studs, said method comprising:

attaching at least one reinforcement member directly to the framing, said at least one reinforcement member being entirely planar and comprising a thin, flat strip of nailable metal, wherein the at least one reinforcement member is in direct contact with at least one of the studs when attached to the framing; and installing the trim member on the framing by attaching one or more fastening tabs disposed on the trim member to the at least one reinforcement member, wherein the fastening tabs are attached to the at least one reinforcement member in a manner such that at least a portion of each fastening tab is concealed from view when the trim member is installed on the framing, wherein no sheathing is positioned between the trim member and the framing.

2. The method of claim 1, wherein said reinforcement member comprises a strapping.

3. The method of claim 1, wherein said reinforcement member comprises steel.

4. The method of claim 1, wherein said reinforcement member has a maximum thickness of 18 Gauge.

5. The method of claim 1, wherein said reinforcement member is 4 to 6 inches wide.

6. The method of claim 1, wherein said reinforcement member is 2 to 4 feet long.

7. The method of claim 1, wherein the reinforcement member is attached to a wood framing.

8. The method of claim 1, wherein the reinforcement member is attached to a steel framing.

9. The method of claim 1, wherein the trim member is a window trim.

10. The method of claim 1, wherein said reinforcement member comprises a plurality of spaced apart indentations extending longitudinally across the reinforcement member.

11. A building finishing element installation assembly comprising:

a building finishing element having an interior surface and an exterior surface;

a plurality of planar tabs attached to the interior surface of the building finishing element in a manner such that a portion of each tab extends outwardly from the lateral edges of the building finishing element; and a reinforcing member comprising a thin, nailable strip of steel, said reinforcing member is entirely planar and is attached to the planar tabs in a manner such that the reinforcing member is in direct contact with substantially the entire length of each planar tab and that the interior surface of the building finishing element is disposed adjacent the steel reinforcement member, wherein the exterior surface of the building finishing element faces outwardly in a manner such that the tabs are positioned between the reinforcing member and the interior surface of the building finishing element; and wherein the reinforcing member is fastened to at least one stud of a building framing such that the reinforcing member directly contacts a surface of the at least one stud and extends in a plane parallel to the surface of the at least one stud.

12. The building finishing element installation assembly of claim 11, wherein the reinforcement member directly contacts a plurality of spaced apart studs of the framing.

13. The building finishing element installation assembly of claim 11, wherein the building framing is a wood framing

14. The building finishing element installation assembly of claim 11, wherein the building framing is a steel framing.

* * * * *